US006230421B1

(12) United States Patent
Reed, Sr. et al.

(10) Patent No.: US 6,230,421 B1
(45) Date of Patent: May 15, 2001

(54) METHOD AND APPARATUS FOR DRYING GRAIN

(75) Inventors: Steven C. Reed, Sr., 4001 S. Ocean Dr., Hollywood, FL (US) 33019; Matthew G. Reed, Hollywood, FL (US)

(73) Assignee: Steven C. Reed, Sr., Hollywood, FL (US)

( * ) Notice: Subject to any disclaimer, the term of this patent is extended or adjusted under 35 U.S.C. 154(b) by 0 days.

(21) Appl. No.: 09/326,584

(22) Filed: Jun. 7, 1999

(51) Int. Cl.[7] ..... F26B 5/14

(52) U.S. Cl. ..... 34/401; 34/431; 34/509; 34/167; 34/168; 34/171; 34/174

(58) Field of Search ..... 34/401, 429, 431, 34/509, 167, 168, 171, 174

(56) References Cited

U.S. PATENT DOCUMENTS

| | | | | |
|---|---|---|---|---|
| 1,554,780 | | 9/1925 | Berrigan et al. | 34/385 |
| 3,058,235 | | 10/1962 | Morris et al. | 34/164 |
| 3,158,448 | | 11/1964 | Wallin et al. | 34/85 |
| 3,161,485 | * | 12/1964 | Buhrer | 34/236 |
| 3,686,773 | * | 8/1972 | Schreiner | 34/203 |
| 3,771,947 | | 11/1973 | Cook | 432/95 |
| 3,793,745 | | 2/1974 | Myers | 34/189 |
| 4,096,793 | * | 6/1978 | Wachter et al. | 99/467 |
| 4,125,945 | | 11/1978 | Westelaken | 34/65 |
| 4,237,622 | | 12/1980 | Francis | 34/147 |
| 5,483,752 | * | 1/1996 | Kreft et al. | 34/164 |

OTHER PUBLICATIONS

*Airbelt: Non–Rotating Drum Dryer*; Futerized Systems, Inc., Emeryville, California; approx. 1973; brochure.

Futer, R. E.; *Conveying Solids with Cooperating Series of Air Jets*; ASME publication; New York, NY; 1968; article; pp1–5.

* cited by examiner

*Primary Examiner*—Pamela Wilson
(74) *Attorney, Agent, or Firm*—Knechtel, Demeur & Samlan

(57) ABSTRACT

A method and apparatus for drying grain in which a plurality of conveyors are mounted one above the other. The discharge end of one conveyor feeds the input end of the next lower conveyor. The conveyors have a porous top surface and are vibrated to move the grain. Warm air is conveyed beneath the top conveyor and every other conveyor thereafter. Cool air is conveyed beneath the conveyor beneath the top conveyor and every other conveyor thereafter. The warm and cool air passes through the porous top surfaces of the conveyors. Thus the conveyors alternately heat and cool the grain to remove moisture to the desired level. The apparatus can be free standing or mounted as part of a combine or harvester.

21 Claims, 4 Drawing Sheets

METHOD AND APPARATUS FOR DRYING GRAIN

This invention is directed to the field of agricultural implements. It is more directly related to a unique method and apparatus for drying grain. The apparatus can be mounted as part of a combine or harvester or may be a freestanding unit.

BACKGROUND AND SUMMARY OF THE INVENTION

Combines and harvesters are typically used to harvest grain and cereal crops. In addition to severing the crop plant from the ground, combines also thrash the severed plants to separate the grains from the stalks, husks, cobs and other residue. After the thrashing is performed on the plants, the products of this process are conveyed to a sifting, shelling and husking process in which the grain is separated from the residue. The residue is usually conveyed to the rear of the combine and is distributed back on the ground by a spreader apparatus located at the rear of the combine.

The grain, after being sifted and separated, is conveyed to a storage bin on the combine. Usually a conveyor is used because the storage bin is located above the separating area of the machine. The grain at this point typically contains high moisture content. With almost all grains harvested, some drying is necessary prior to storage, sale and delivery. Without drying, the grain is much more prone to bacteria growth and rotting. It also reduces the probability of later hot spot formations during subsequent storage of the grain, which reduces the possibility of fires.

Current techniques require the grain dryer to be placed next to the storage bins or silos as they are sometimes referred to. Grain drying is costly not only in fuel costs, but also for the equipment that is needed to support the drying operation. Additionally labor and transportation costs must be included in the overall cost of drying the grain. There is also the down time spent in waiting for the dryer to catch up with the grain harvested by the combine. At this time, the combine can harvest faster than the grain can remove moisture from the grain. This can be extremely costly if weather problems arise. There is only a limited optimum harvesting time and to maximize efficiency, it is necessary to harvest, dry and store as much of the crop as possible in the short time frame allowed.

In a conventional system, the steps taken by the farmer after the grain has been harvested and is ready to be transported to the grain center for drying and storage are as follows. First, the grain is off-loaded into the farm receptacle and is then transported to the grain center. Second, the receptacle is off-loaded into a holding bin via a conveyor from a dumping pit. Third, the grain is tested for moisture content and is then transferred to the dryer. Fourth, the grain is dryer and transferred to a holding bin where it is again tested for moisture to be readied for storage or delivered for immediate sale. Fifth, the dried grain is conveyer into final storage bins, or loaded into vehicles for delivery.

These steps are accomplished with the use of conveyors and other grain handling equipment. The costs involved are substantial. The down time lost waiting for the dryer to catch up after the first days harvest can amount to thirty to fifty percent of the daylight hours on a daily basis.

The cost to construct a normal drying process as known and practiced today can cost upwards of a quarter of a million dollars depending on the amount of grain to be processed. In additions to being inefficient in the drying process, it is also inefficient in its energy consumption. As the amount of moisture to be removed from the grain increases, the inefficiency of the system results in tremendous waste.

For example shelled corn must not have moisture content of more than 15 percent when it is stored, or it faces the possibility of spoilage. When severed from the ground, however, corn kernels have moisture content of between 20 and 24 percent. Under the most favorable circumstances, the kernels must be dried to eliminate at least five percent of their moisture content. Under the worst circumstances, they must be dried to eliminate nine percent. At present energy prices, costs for drying one bushel of shelled corn to a point where it can be stored are at least 6.5 cents per each percentage point of moisture content which must be eliminated. The costs, therefore, for drying one bushel of shelled corn would range between thirty-two and fifty-eight cents. When considering that six to seven billion bushels of corn are harvested annually, one can see that an extremely significant overall cost is involved. Even slight savings per bushel will result in tremendous overall savings.

Various types of grain dryers have been invented in the past. For example U.S. Pat. No. 1,554,780 issued to Berrigan et al. for Drier and Process of Drying illustrates a drier used to dry solid material removed from sludge. The material falls through a series of flames for drying. A series of inclined baffle plates direct the flow of the solid material. The flames used in this patent would burn the grain if applied to a grain drying process U.S. Pat. No. 3,058,235 issued to Morris et al. for Vibratory Heat Transfer Apparatus. This patent illustrates a box like frame supported on a series of springs. A vibrating force is applied to the frame causing it to vibrate. A plurality of sloping pervious trays is mounted in the box. The material to be dried is introduced through an entrance chute and passes over each tray as it travels back and forth from one tray to the next lower tray. To minimize the escape of the treating gas a flexible curtain is used. The gas flows into manifolds located on the sides of the box and through ports into the spaces directly below the porous trays. The trays are enclosed on the sides and bottoms. The gas, after passing through the trays, is exhausted. Only one temperature of heated air is used to dry the grain.

U.S. Pat. No. 3,158,448 issued to Wallin et al. for Drier With Gas-Moved Bed of Material discloses a conveyor system in which gas flows through a porous conveyor supporting a bed of material which is to be dried. The patent discloses an improved means for cleaning the air duct U.S. Pat. No. 3,771,947 issued to Cook for Apparatus and Method for Heating Flowable Material is directed to a method of making asphalt paving materials. It uses high temperature gas injected at a high velocity to fluidize the particles as they drop though a drop zone. It is not adaptable to a grain drying application, as it would burn the grain. It also does not use a vibrating conveyor or a series of heating and cooling steps.

U.S. Pat. No. 3,793,745 issued to Myers for Aggregate Dryer moves aggregate upwardly from the bottom of the housing to the top. A series if conveyors does the upward movement in a conventional manner. Heaters dry the aggregate as it moves upward.

U.S. Pat. No. 4,125,945 issued to Westelaken for Multiple Stage Dryer with Intermediate Steeping illustrates a grain drying tower in which the grain passes from top to bottom by gravity flow. There are intermediate drying zones, which end in a cooling zone U.S. Pat. No. 4,237,622 issued to Francis for Dryer Using Vibratory Feeding designed for drying small industrial parts. The parts move along a vibrating helical ramp. There is an air plenum, which continuously introduces heated air onto the ramp None of the devices disclosed in the patents discussed above have come close to achieving the desired goals of a low cost dryer that is compact in size, efficient to operate, and can be either a stand alone unit or incorporated with a combine or harvester. Applicant's invention has achieved all of these goals. Furthermore it has reduced the cost of drying a bushel of corn by at least fifty per cent depending on the amount of moisture reduction.

Applicant's invention utilizes a unique method and apparatus for drying grain or other similar products, which require moisture reduction. The grain is introduced into the top of the dryer usually by means of a conveyor. The moisture and temperature is sensed to determine if additional moisture must be removed. The grain is moved through a series of partially enclosed vibrating conveyors. The magnitude of vibration determines the speed of the grain. The conveyors are arranged in an alternating, overlapping, stair step configuration to promote a compact design with the dried grain exiting near the original combine grain transfer point. The conveyors all have porous bases to allow airflow up through the conveyor. A heat source supplies heated air to alternate conveyors. Ambient or cool air is supplied to the other alternate conveyors such that a cool air conveyor separates each heated air conveyor. The heat and humidity is monitored as the grain moves along each conveyor. A control system controls the temperature of the heated air, the vibration of the conveyors, and the resulting speed of grain movement. The entire apparatus can be mounted in conjunction with a combine or harvester or built as a stand-alone unit.

OBJECTS AND ADVANTAGES

It is an object of the invention to provide a new and unique method and apparatus for drying grain and the like which utilizes a vibrating conveyor system to transport grain from the inlet to the outlet. It is a related object to use a vibrating conveyor system that blows warm or cool air through alternate conveyors to alternately heat and cool the grain to remove moisture from the grain.

It is another object to provide a vibrating conveyor system in which the speed of grain travel is controlled by the vibration of the conveyor system.

It is another object to provide a grain dryer that is compact in design so that it may be connected to or built integral with a combine or harvester. A related object is to provide such a grain dryer that can also be manufactured of the same, compact design that is suitable for stationary mounting.

Another object is to provide a method and apparatus for grain drying that has a greater capacity for drying grain in a given amount of volume than previously designed systems.

Yet another object is to provide a grain dryer that is more energy efficient than previous grain dryers and reduces the cost of drying grain.

These and other objects and advantages will be apparent from reading the Detailed Description of the Drawings and Description of the Preferred Embodiment.

DETAILED DESCRIPTION OF THE DRAWINGS

DESCRIPTION OF THE PREFERRED EMBODIMENT

Figure 1:
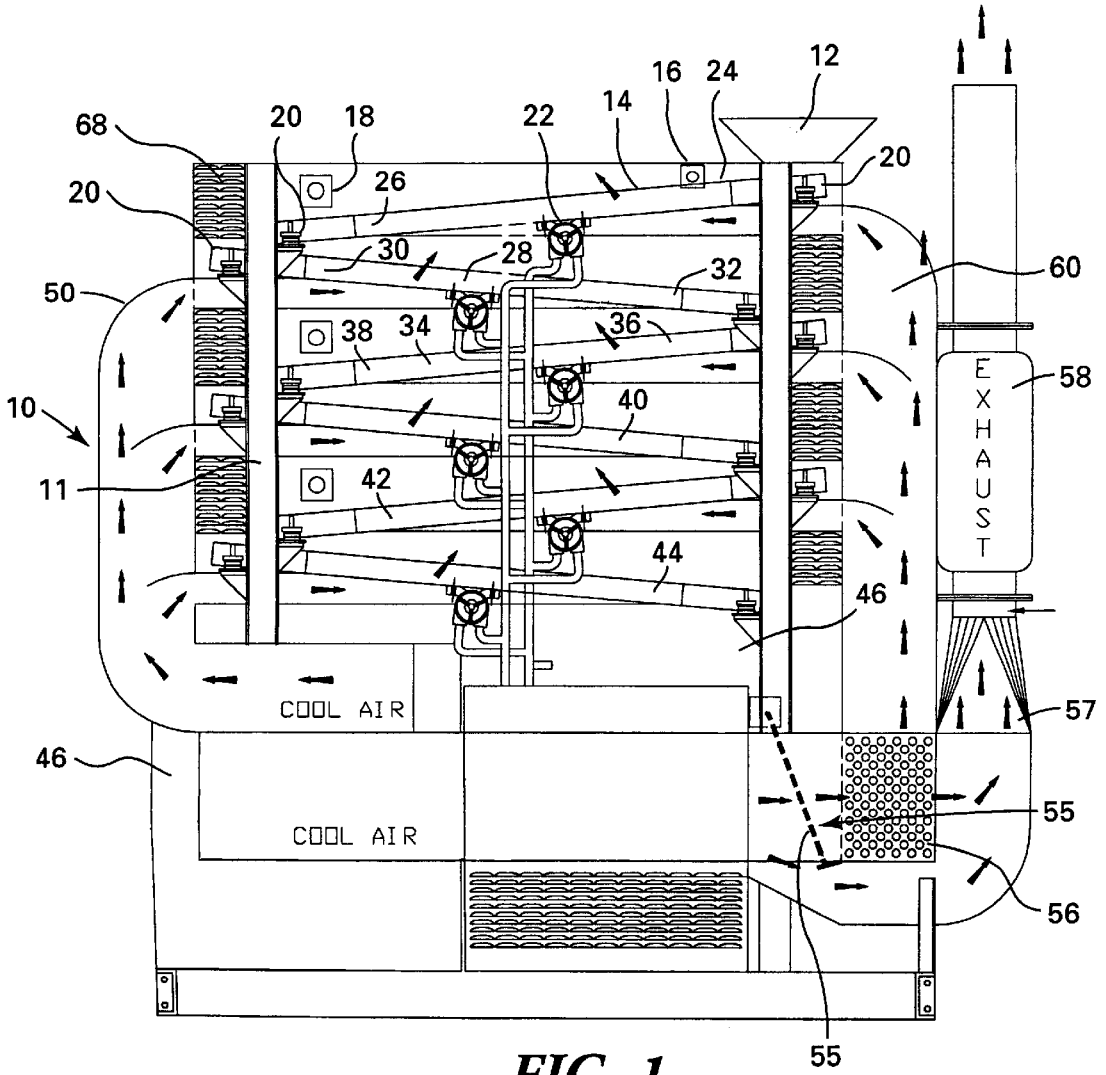
FIG. 1 is a schematic side elevation view of the inventive drying apparatus with parts removed to illustrate the internal configuration.
Figure 2:
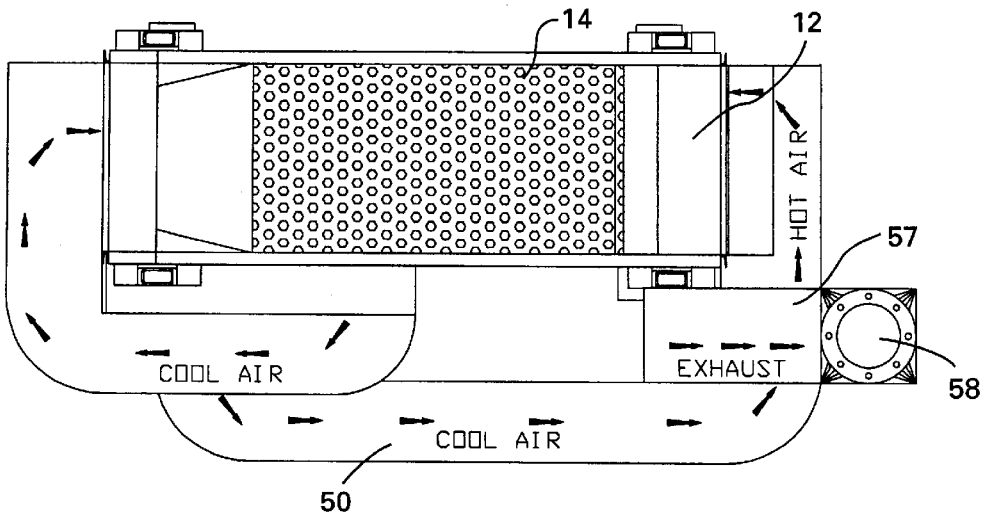
FIG. 2 is a top plan view of the apparatus of FIG. 1.
Figure 3:
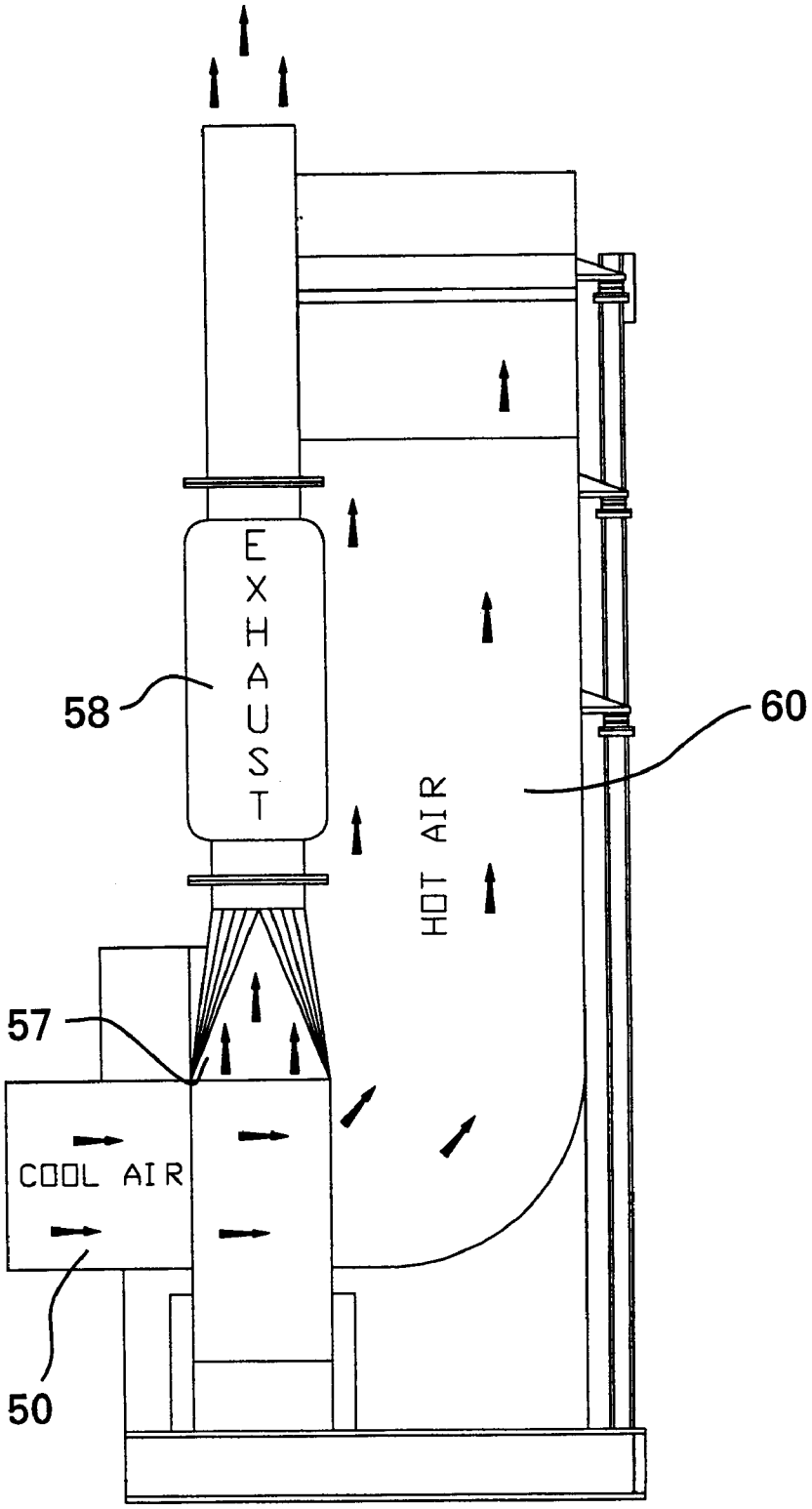
FIG. 3 is a right side view of the apparatus of FIG. 1.
Figure 4:
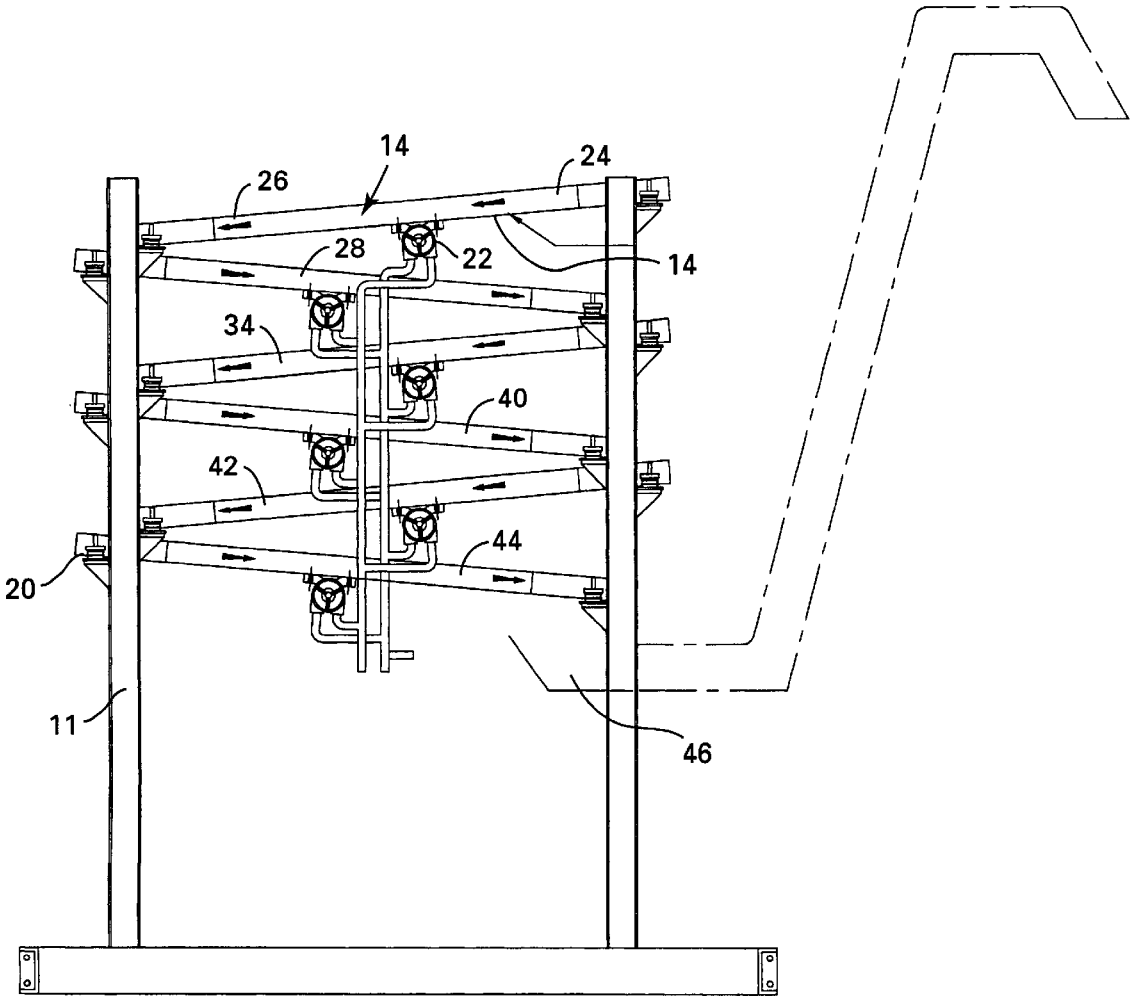
FIG. 4 is a schematic side elevation view of the vibrating conveyor system in the drying apparatus.

Turning first to FIG. 1 there is illustrated a grain dryer 10 constructed on structural supporting frame 11 of the present invention. Although the device is primarily intended to dry grains and corn prior to storage, the device has other applications. For example, after grains or corn are extruded at an ethanol processing plant, the byproduct is compressed into pellets. The pellets have a high moisture content which must be reduced prior to shipment and storage. Applicant's invention is suitable for use with any such process requiring extraction of moisture from products as small as granular size through products having a dimension of approximately an inch in length, width, or depth. With appropriate modifications to the equipment, even larger products can be accommodated. In fact, Applicant's invention will work on any material that can be conveyed by a vibratory conveyor. Although throughout the specification the term "grain" will be frequently used, the invention is applicable to any sort of grain or corn product or other product which may be conveyed by the conveyor system.

The grain is introduced through a grain inlet 12 which is in the form of a funnel shaped hopper. The grain is normally fed to the hopper 12 from a grain transfer point by means of a grain auger or other such similar conveyor system. From the grain inlet 12, the grain is transported to a first conveyor 14 by means of a grain auger (not illustrated) which is similar to the auger used to transport the grain to the inlet 12. The grain is sampled by a humidistat or humidity transducer 20 to determine the moisture content of the grain. A temperature transducer or sensor 18 determines the temperature of the grain at the start of the drying process. Based upon the initial input of temperature and humidity or moisture, the operator can determine if the dryer is necessary to further reduce the moisture content of the grain.

A vibrating conveyor is used to move the grain along the first conveyor 14. It is about sixty inches long by twenty-four inches wide and made from perforated stainless steel. The first conveyor 14 is mounted on isolators 20 located at either end of the conveyor. A motor 22 is connected to the conveyor 14 to cause it to vibrate as is commonly known in the art. The motor can either be a hydraulic motor, a pneumatic motor, or an electric motor. The magnitude of vibration generated by the motor 22 will determine the speed of the grain as it moves along the conveyor 14. The grain moves from a receiving end 24 to a discharge end 26 of the conveyor. As can be seen in FIG. 1, the receiving end 24 is slightly elevated with respect to the discharge end 26. This assists in the gravity feed of the grain from the receiving end 24 to the discharge end 26. Furthermore, the angle of the conveyor 14 can be adjusted by a cam or other suitable means to increase or decrease the angle, and, thus, the speed of the grain as it travels. This can be varied in conjunction with the speed of vibration to accurately control the speed of the grain as it moves along the conveyor 14.

Below the first conveyor 14 is a second conveyor 28. This has a receiving end 30 positioned just below the discharge end of the first conveyor end 14. Opposite the receiving end 30 is a discharge end 32 which is positioned below the receiving end 24 of the first conveyor. A third conveyor 34 is mounted below the second conveyor 28. It also has a receiving end 36 positioned below the discharge end 32 of the second conveyor 28. At its opposite end is a discharge end 38 which is positioned below the receiving end 30 of the second conveyor 28. As seen in FIG. 1, there are three additional conveyors, a fourth conveyor 40, a fifth conveyor 42, and a sixth conveyor 44, arranged in a stair step configuration such that the grain moves back and forth from one side of the dryer to the other. This promotes a compact design by having the path that the grain follows zigzag up and back across the conveyors which are oriented one on top of the other. There is a grain discharge area 46 near the bottom of the grain dryer 10 such that it is not too far removed from the beginning grain transfer point.

Each of the conveyors has its own vibrating motor 22 which, as stated previously, can be either pneumatically, electrically, or hydraulically operated. Furthermore, each if the conveyors are mounted on isolators 20 which isolate the vibration of the conveyor from the frame and from each other. Each conveyor also can have its angle separately adjusted.

In order to effectively remove moisture from the grain as it is transported through the dryer, a series of air movement ducts have been provided. As can be more clearly seen in FIGS. 5 and 6. A duplex industrial type blower fan 46 draws ambient air into the fan. The fan is operated either by an electric motor or hydraulic fan motor. It must be capable of generating sufficient positive pressure as required by the system. In Applicant's design, a 23,300 cu. ft./ min. industrial blower was utilized. It operated at 860 RPM's and required a 25 horsepower a motor to drive it. The blower must meet Class 1 performance for use in ventilation, exhausting and drying. The blower 46 is of the double width, double inlet design which is specifically a high volume low velocity blower.

The duplex fan 46 draws ambient air from the outside and directs a portion of it to a cold air duct or manifold 50. This runs vertically upward along the side of the grain dryer 10. There is a series of cold air feeder ducts or chambers 52 oriented below the second, fourth, and sixth conveyors 28, 40, and 44. The cold air feeder ducts 52 have either a perforated or completely open upper surface to allow the cold ambient air to pass up through the perforated conveyors 28, 40, and 44. Alternatively, the fan 46 can blow refrigerant or cooled air through the duct 50.

The duplex fan 46 diverts a portion of the ambient air to a warm air feeder duct or manifold 54. The duct 54 runs horizontally along the side of the dryer 10. Air flowing through the duct 54 is directed by a diverter gate 55 to a heat exchanger 56 that can be of any suitable design. A heat source that can be heated by gas, electric, propane solar or other fuel provides the necessary heat to heat the heat exchanger 56. The byproducts of combustion from the heat source are exhausted through an exhaust manifold 58. Also the air directed around the diverter gate 55 goes into the exhaust manifold 57. A spark arrester 58 is attached to the exhaust manifold 57 to minimize the possibility of sparks being discharged into the grain environment. By controlling the diverter gate 55, only the necessary amount of air enters the heat exchanger 56.

The heated air from the heat exchanger 56 enters a heated air duct 60. There are a series of hot air feeder ducts 62 oriented below the first, third, and fifth conveyors 14, 34, and 42. The hot air feeder ducts 62 are either perforated or completely open just as the cold air ducts 52, to allow the hot air to pass up through the perforated conveyors 14, 34, and 42.

The design of the cold air and hot air ducts 52 and 62 are similar. Both are fed from open entrances from their respective air ducts 50 or 60. Both have solid sheet metal bottoms 64. Their sides are defined by a sheet metal skin 66 attached to the frame 11. The tops are either completely open or present a perforated sheet metal surface to the underside of their respective conveyors. Each of the ducts thus forms an enclosed air passageway that feeds air to the bottom of the conveyors.

Figure 5:
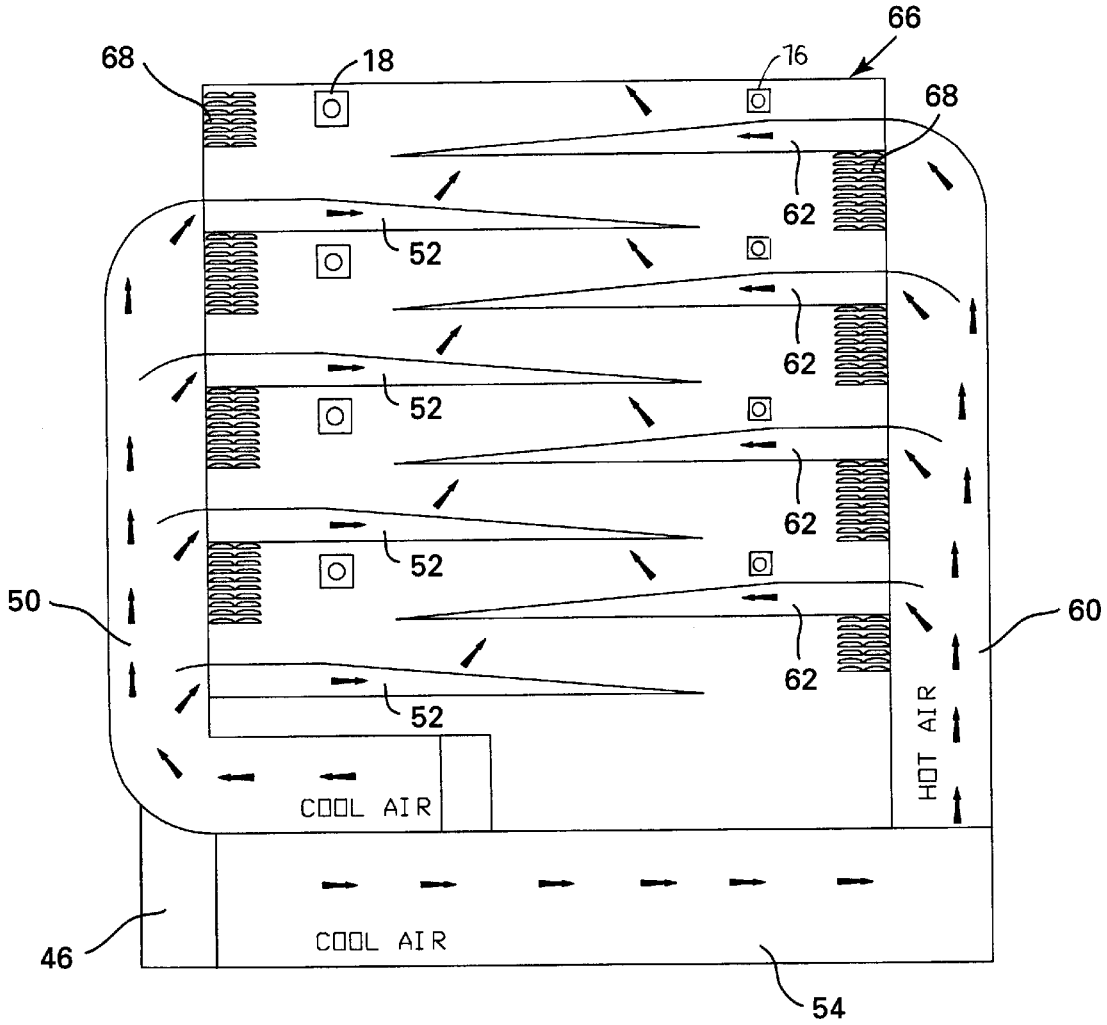
FIG. 5 is a schematic side elevation view of the flow of heated air and cool air to alternate conveyor enclosures.
Figure 6:
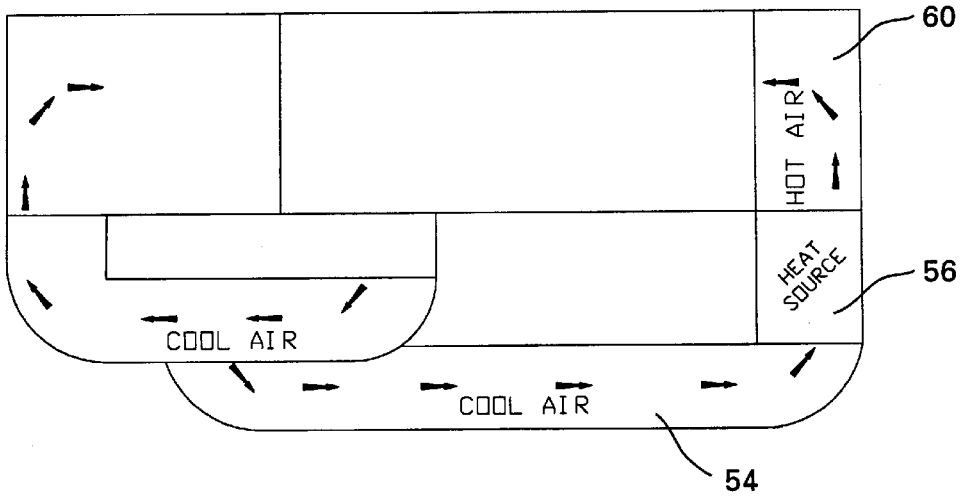
FIG. 6 is a top plan view of the apparatus of FIG. 5.

As can be seen in FIG. 5, there are air exhaust louvers 68 at each conveyor level. The warm air passing through the first conveyor 14 contacts the entire surface of the grain, uniformly heats the grain, and picks up moisture from the entire grain surface. The air rises and is exhausted through the top left louver 68 as seen in FIG. 5. The cool air passing through the second conveyor 28 is exhausted through the next lower louver 68 on the right. Each conveyor has a louver associated with it to remove the air passing through its respective conveyor.

A control system monitors the operation of the system. When the grain enters the first conveyor 14, the humidistat 16 and temperature transducer 18 measures the moisture and temperature. This data is entered into a programmable controller. The temperature and volume of heated air passing through the first conveyor is calculated and adjustments are made to the heat source and air volume controls. The angle and vibration of the conveyor controls the speed of the grain. As the grain moves from first conveyor 14 to the second conveyor 28, the amount of cooling air required for cooling the grain to a predetermined temperature and humidity is calculated. Adjustments are made to the angle and speed of the second conveyor 28. The cool air passing through the cooling conveyors contacts the entire grain surface. It uniformly cools the grain, and blows the moisture away through the louvers at the end of each cooling conveyor. The process is repeated as the grain moves through each of the conveyor levels. The grain is alternately heated by the warm air and then cooled by the cooling air. The moisture is removed from the grain at each level by first heated air driving moisture to the surface of the grain and removing it, and then on the cooling conveyor by the cool air blowing moisture away that had been moved to the surface of the grain. The entire process is adaptable to control by a programmable controller. The operator only must enter several pieces of information such as the type of grain and desired final moisture content and the controller will calculate the operating parameters. The system is also equipped with the necessary safety features to shut down in the event of overheating, fire, heat source or blower malfunction.

Thus there has been provided a method and apparatus for grain drying that fully satisfies the objects and advantages as set forth herein. It will be apparent to those skilled in the art that various changes may be made to the specific embodiment described herein without departing from the scope and spirit of the invention and such modifications are intended to be encompassed by the appended claims.

What is claimed is:

1. A device for drying loose bulk material comprising:

an upper and a lower conveyor tray, each having a porous top surface for receiving loose bulk material thereon, each conveyor tray having a receiving end and a discharge end, the conveyor trays mounted one above the other with the discharge end of the upper conveyor tray positioned to feed the receiving end of the lower conveyor tray for conveying the loose bulk material from the upper conveyor tray to the lower conveyor tray, means for vibrating each of the conveyor trays to produce a loose bulk material vibratory path in a direction along the conveyor trays to move the loose bulk material from the receiving end to the discharge end of the conveyor trays, means for conveying a gas at a first temperature above ambient temperature beneath the upper conveyor tray for movement of the gas through the porous surface and heating the loose bulk material thereon, and means for conveying a cooling fluid at a second temperature below the fist temperature of the gas beneath the lower conveyor tray and cooling the loose bulk material thereon.

2. The device of claim 1 and further comprising a frame and means to mount the conveyor trays to the frame.

3. The device of claim 2 and further comprising an upper tray enclosure mounted beneath the upper enclosure and a lower tray enclosure mounted beneath the lower tray.

4. The device of claim 3 and further comprising a first manifold connected to the upper tray enclosure for conveying the gas at a temperature above ambient temperature and a second manifold connected to the lower tray enclosure for conveying the cooling fluid.

5. The device of claim 1 wherein the cooling fluid is ambient air.

6. The device of claim 1 wherein the cooling fluid is air at below ambient temperature.

7. The device of claim 1 and further comprising at least third and fourth conveyor trays having top porous surfaces for receiving the loose bulk material thereon, the third and fourth conveyor trays having receiving ends and discharge ends and being mounted one above the other with the receiving ends of the third and fourth conveyor trays positioned below the discharge ends of the second and third conveyor trays respectively.

8. The device of claim 7 and further comprising tray enclosures mounted beneath each of the third and fourth conveyor trays, with the first manifold connected to the tray enclosures of the first and third conveyor trays and the second manifold connected to the tray enclosures of the second and fourth conveyor trays.

9. The device of claim 7 and further comprising fifth and sixth conveyor trays having top porous surfaces for receiving grain thereon, the fifth and sixth conveyor trays having receiving ends and discharge ends and being mounted one above the other with the receiving ends of the fifth and sixth conveyor trays positioned below the discharge ends of the fourth and fifth conveyor trays respectively.

10. The device of claim 9 and further comprising tray enclosures mounted beneath each of the fifth and sixth conveyor trays, with the first manifold connected to the first, third and fifth tray enclosures and the second manifold connected to the second, fourth and sixth tray enclosures.

11. The device of claim 1 wherein a blower is used to convey the gas and cooling fluid beneath the conveyor trays.

12. The device of claim 1 and further comprising means for attaching the device to harvesting equipment for moving the device with the harvesting equipment.

13. A device for drying loose bulk material comprising:

a frame, a plurality of conveyor trays each having a porous top surface, the conveyor trays mounted to the frame, each conveyor tray having a receiving end and a discharge end, the conveyor trays mounted vertically with respect to each other with the discharge end of each conveyor tray mounted to feed the receiving end of the next lower conveyor tray for conveying the loose bulk material from one conveyor tray to the next lower conveyor tray, a plurality of conveyor tray enclosures, each mounted beneath one of the conveyor trays, a first manifold connected to at least one of the conveyor tray enclosures, means for conveying a gas at a temperature above ambient temperature from the manifold into the conveyor tray enclosure beneath its respective conveyor tray for movement through the porous surface and the loose bulk material thereon, a second manifold connected to at least one other conveyor tray enclosure, means for conveying cooling fluid at a temperature below the temperature of the gas from the second manifold into the at least one other conveyor tray enclosure beneath its respective conveyor tray for movement through the porous surface and the loose bulk material thereon.

14. The device of claim 13 wherein the cooling fluid is ambient air.

15. The device of claim 13 wherein the cooling fluid is air at below ambient temperature.

16. The device of claim 13 wherein there are two conveyor trays.

17. A method for drying loose bulk material comprising the steps of:

providing a plurality of conveyor trays, one of the conveyor trays being a top conveyor tray, each conveyor tray having a porous top surface and each conveyor tray having an entrance end and a discharge end, mounting the conveyor trays to a frame with the discharge end of one conveyor tray positioned above the entrance end of the next lower conveyor tray, introducing loose bulk material onto the entrance end of the top conveyor tray, vibrating the conveyor trays causing the loose bulk material placed thereon to move from the entrance end to the discharge end of each conveyor tray, blowing warm air at a temperature above ambient temperature beneath one of the plurality of conveyor trays and passing the warm air through the porous surface to heat and remove moisture from the loose bulk material, blowing cool air at a temperature below the warm air temperature beneath another of the plurality of conveyor trays located below the one of the plurality of conveyor trays and passing the cool air through the porous surface to cool and remove moisture from the loose bulk material, and discharging the loose bulk material to a collection area.

18. The method of claim 17 and the additional step of venting the warm air to the atmosphere after it passes through the porous surface and heats the loose bulk material.

19. The method of claim 17 and the additional step of venting the cool air to the atmosphere after it passes through the porous surface and cools the loose bulk material.

20. The method of claim 17 and the additional step of controlling the movement of the loose bulk material along the conveyors by controlling the vibration of the conveyor trays.

21. The method of claim 17 and the additional step of controlling the temperature of the warm air to control the heating of the loose bulk material and in the amount of moisture removed from the loose bulk material.

* * * * *

UNITED STATES PATENT AND TRADEMARK OFFICE

CERTIFICATE OF CORRECTION

PATENT NO. : 6,230,421 B1
DATED : May 15, 2001
INVENTOR(S) : Reed, Sr. et al.

It is certified that error appears in the above-identified patent and that said Letters Patent is hereby corrected as shown below:

Column 5,
Line 26, delete "." and change "As" to -- as --;
Line 33, delete "a" the second time it appears;
Line 54, after the word "propane" insert a comma (-- , --).

Claim 21,
Line 3, delete "in"

Signed and Sealed this

Thirteenth Day of November, 2001

*Attest:*

Nicholas P. Godici

NICHOLAS P. GODICI
*Acting Director of the United States Patent and Trademark Office*

*Attesting Officer*